US009618958B2

(12) United States Patent
Jang et al.

(10) Patent No.: US 9,618,958 B2
(45) Date of Patent: Apr. 11, 2017

(54) CURRENT GENERATOR, METHOD OF OPERATING THE SAME, AND ELECTRONIC SYSTEM INCLUDING THE SAME

(71) Applicant: SAMSUNG ELECTRONICS CO., LTD., Suwon-si (KR)

(72) Inventors: Tae Kwang Jang, Hwaseong-si (KR); Jen Lung Liu, Seoul (KR); Nan Xing, Seoul (KR); Jae Jin Park, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 334 days.

(21) Appl. No.: 14/203,797

(22) Filed: Mar. 11, 2014

(65) Prior Publication Data

US 2014/0266137 A1 Sep. 18, 2014

(30) Foreign Application Priority Data

Mar. 15, 2013 (KR) ..... 10-2013-0027808

(51) Int. Cl.
*G05F 3/24* (2006.01)
*G05F 3/26* (2006.01)

(52) U.S. Cl.
CPC ..... *G05F 3/242* (2013.01); *G05F 3/26* (2013.01)

(58) Field of Classification Search
CPC ..... G05F 3/26; G05F 3/242
USPC ..... 323/312, 313, 314, 315, 316, 907
See application file for complete search history.

(56) References Cited

U.S. PATENT DOCUMENTS 4,296,382 A * 10/1981 Hoover ..... H03F 1/342 330/264
4,805,025 A * 2/1989 Akiyama ..... G11C 19/285 348/250
5,485,074 A 1/1996 Tomasini et al.
5,783,936 A * 7/1998 Girard ..... G05F 3/262 323/315
6,448,844 B1 * 9/2002 Cho ..... G05F 3/242 327/538
6,642,793 B2 11/2003 Phanse et al.
7,667,533 B1 2/2010 Tan et al.
7,948,330 B2 5/2011 Seo et al.
8,358,119 B2 * 1/2013 Kim ..... G05F 3/242 323/313
2004/0140845 A1 7/2004 Eberlein
(Continued)

FOREIGN PATENT DOCUMENTS

JP 2008-219116 A 9/2008
KR 10-0657822 B1 12/2006
KR 10-0668414 B1 1/2007

*Primary Examiner* — Fred E Finch, III
*Assistant Examiner* — Rafael O De Leon Domenech
(74) *Attorney, Agent, or Firm* — Sughrue Mion, PLLC

(57) ABSTRACT

A current generator includes a first current generation circuit configured to generate a first current having a first current noise which depends on a change in a supply voltage, a second current generation circuit configured to generate a second current having a second current noise which depends on the change in the supply voltage, and a current subtracting circuit configured to generate a third current with the first current noise and the second current noise removed by subtracting the second current from the first current.

11 Claims, 8 Drawing Sheets

(56) References Cited

U.S. PATENT DOCUMENTS

| | | | | |
|---|---|---|---|---|
| 2007/0159253 | A1* | 7/2007 | Koh | H03F 3/45183 330/255 |
| 2009/0153233 | A1 | 6/2009 | Arai | |

* cited by examiner

CURRENT GENERATOR, METHOD OF OPERATING THE SAME, AND ELECTRONIC SYSTEM INCLUDING THE SAME

CROSS-REFERENCE TO RELATED APPLICATIONS

This application claims priority from Korean Patent Application No. 10-2013-0027808 filed on Mar. 15, 2013, in the Korean Intellectual Property Office, the disclosure of which is hereby incorporated by reference in its entirety.

BACKGROUND

Exemplary embodiments relate to a current generator, a method of operating the same, and an electronic system including the same. In particular, exemplary embodiments relate to a current generator for generating current regardless of the change in a supply voltage, a method of operating the same, and an electronic system including the same.

There has been a lot of research and development on components of smartphones, smart pads, and/or tablets. Since these portable devices are driven by an internal battery, the portable devices should operate at low power. When the portable devices are driven with low power, there may be power instability. However, some of the circuits used in the portable devices require a stable reference current/voltage. Therefore, a circuit for generating a stable current/voltage, regardless of any power instability occurring, is desired for the reliable operation of the portable devices.

SUMMARY

According to an aspect of the exemplary embodiments, there is provided a current generator including a first current generation circuit configured to generate a first current having a first current noise which depends on a change in a supply voltage, a second current generation circuit configured to generate a second current having a second current noise which depends on the change in the supply voltage, and a current subtracting circuit configured to generate a third current with the first current noise and the second current noise removed by subtracting the second current from the first current.

The first current may be a result of scaling a first reference current generated from the supply voltage at a first ratio, and the second current may be a result of scaling a second reference current generated from the supply voltage at a second ratio.

The third current may have a rate of change with respect to the supply voltage, which is determined according to the first ratio, the second ratio, a third ratio, and a fourth ratio. The third ratio may be a rate of change in the first reference current with respect to the supply voltage, and the fourth ratio may be a rate of change in the second reference current with respect to the supply voltage.

The first current generation circuit may include a first variable resistor configured to change the third ratio, and the second current generation circuit may include a second variable resistor configured to change the fourth ratio.

The current generator may further include a current output circuit configured to remove residual noise from the third current, and output the third current with the residual noise removed.

The current output circuit may include an RC filter.

The current output circuit may include a plurality of transistors whose source and drain are connected.

According to another aspect of the exemplary embodiments, there is provided an electronic system including the above-described current generator, an oscillator configured to receive the third current and generate a clock signal, and a control unit configured to generate a current control signal which controls the current generator according to a frequency of the clock signal.

According to yet another aspect of the exemplary embodiments, there is provided a method of operating a current generator. The method includes generating a first current having a first current noise which depends on a change in a supply voltage, generating a second current having a second current noise which depends on the change in the supply voltage, and generating a third current with the first current noise and the second current noise removed by subtracting the second current from the first current.

The first current may be a result of scaling a first reference current generated from the supply voltage at a first ratio, and the second current may be a result of scaling a second reference current generated from the supply voltage at a second ratio.

The third current may have a rate of change with respect to the supply voltage, which is determined according to the first ratio, the second ratio, a third ratio, and a fourth ratio. The third ratio may be a rate of change in the first reference current with respect to the supply voltage, and the fourth ratio may be a rate of change in the second reference current with respect to the supply voltage.

The generating the first current may include changing the third ratio, and the generating the second current may include changing the fourth ratio.

The method may further include removing residual noise from the third current, and outputting the third current with the residual noise removed.

The removing the residual noise may include removing thermal noise and flicker noise using an RC filter.

Alternatively, the removing the residual noise may include removing third current noise which depend on the change in the supply voltage using a plurality of transistors whose source and drain are connected.

According to yet another aspect of the exemplary embodiments, there is provided a current generator including a first current generation circuit including a plurality of first transistors configured to mirror a first reference current and generate a first current by scaling up or scaling down the first reference current, a second current generation circuit including a plurality of second transistors configured to mirror a second reference current and generate a second current by scaling up or scaling down the second reference current, and a current subtracting circuit including a plurality of third transistors configured to generate a third current by subtracting the second current form the first current.

BRIEF DESCRIPTION OF THE DRAWINGS

The above and other features and advantages of the exemplary embodiments will become more apparent by describing in detail exemplary embodiments thereof with reference to the attached drawings in which.

DETAILED DESCRIPTION OF THE EXEMPLARY EMBODIMENTS

Figure 1:
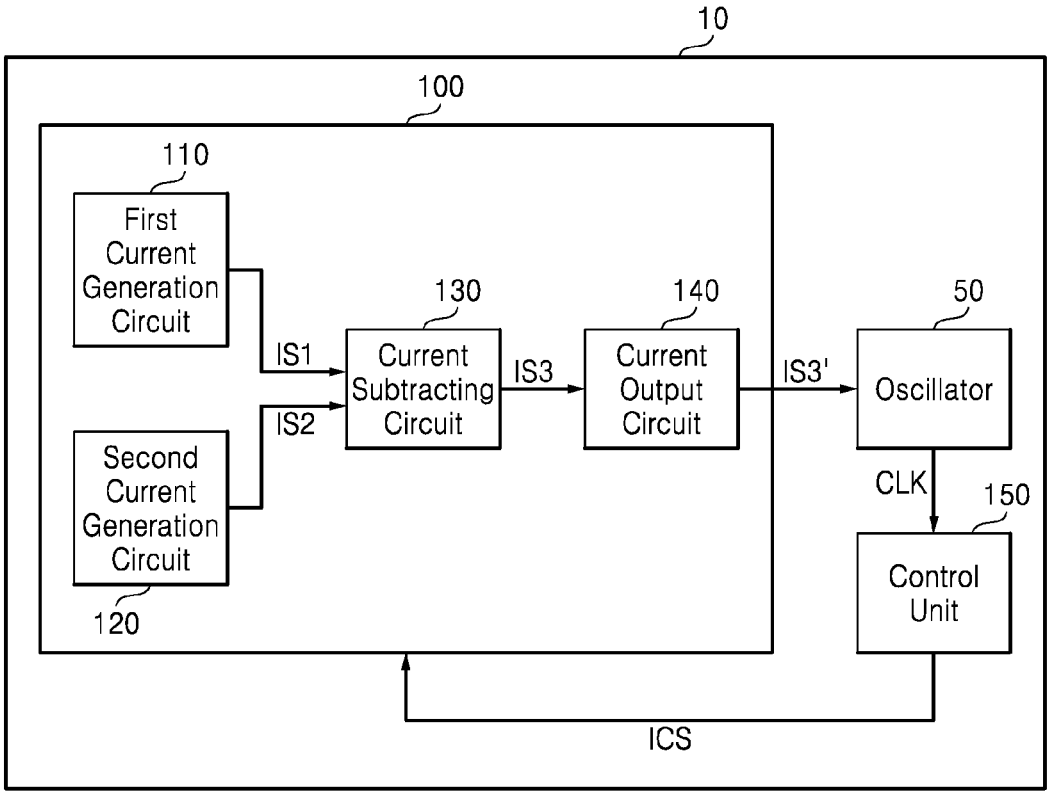
FIG. 1 is a block diagram of an electronic system according to some embodiments.

Exemplary embodiments will be described more fully hereinafter with reference to the accompanying drawings, in which embodiments are shown. These exemplary embodiments may, however, be embodied in many different forms and should not be construed as limited to the embodiments set forth herein. Rather, these embodiments are provided so that this disclosure will be thorough and complete, and will fully convey the scope to those skilled in the art. In the drawings, the size and relative sizes of layers and regions may be exaggerated for clarity. Like numbers refer to like elements throughout.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. As used herein, the term "and/or" includes any and all combinations of one or more of the associated listed items and may be abbreviated as "/".

It will be understood that, although the terms first, second, etc. may be used herein to describe various elements, these elements should not be limited by these terms. These terms are only used to distinguish one element from another. For example, a first signal could be termed a second signal, and, similarly, a second signal could be termed a first signal without departing from the teachings of the disclosure.

The terminology used herein is for the purpose of describing particular embodiments only and is not intended to be limiting of the exemplary embodiments. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which the exemplary embodiments belong. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

FIG. 1 is a block diagram of an electronic system 10 according to some embodiments. The electronic system 10 may include an oscillator 50, a current generator 100, and a control unit 150. The electronic system 10 may be implemented as a portable device. The portable device may be a semiconductor device such as a cellular phone, a smart phone, a smart pad, or a tablet personal computer (PC).

The oscillator 50 may be a digitally controlled oscillator (DCO), voltage controlled oscillator (VCO), or a ring oscillator. The oscillator 50 may be supplied with current from the current generator 100, and generate and output a clock signal CLK having a predetermined frequency to a peripheral circuit (not shown) or the control unit 150.

The current generator 100 may include a first current generation circuit 110, a second current generation circuit 120, a current subtracting circuit 130, and a current output circuit 140. The first current generation circuit 110 may be supplied with a voltage from a voltage generation circuit (not shown, e.g., a battery) within the electronic system 10 and generate a first current IS1 according to the supply voltage. The first current IS1 may have a first current noise depending on the change in the supply voltage.

In an ideal situation, the supplied voltage remains at a predetermined voltage level regardless of time. However, the supply voltage is not maintained at the predetermined voltage level, and is changed over time during the operation of the electronic system 10 due to various factors (e.g., instability during the discharge of internal power or momentary overload). Therefore, the first current IS1 has the first current noise.

The second current generation circuit 120 may be supplied with the voltage from the voltage generation circuit in the electronic system 10 and generate a second current IS2 according to the supply voltage. Similar to the first current IS1, the second current IS2 may have a second current noise depending on the change in the supply voltage.

The current subtracting circuit 130 may perform subtraction on the first current IS1 and the second current IS2, and generate a third current IS3 with the first current noise and the second current noise removed. Elements of the first and second current generation circuits 110 and 120 may be designed to remove the first current noise and the second current noise from the first current IS1 and the second current IS2. The internal conditions of the first and second current generation circuits 110 and 120 for removing the first current noise and the second current noise will be described in detail with reference to FIG. 3. When necessary, the power supply rejection ratio of the first and second current generation circuits 110 and 120 may be changed according to a current control signal ICS output from the control unit 150.

The current output circuit 140 may remove residual noise from the third current IS3. The residual noise includes thermal noise, flicker noise, and third current noise. The thermal noise is noise caused by heat generated during the operation of the electronic system 10. The flicker noise is noise caused by conductivity fluctuation and is inverse proportion to frequency. Accordingly, there may be high flicker noise at low frequency. The third current noise is current noise occurring according to the supply voltage applied to the current output circuit 140. The current output circuit 140 may output a noise-removed third current IS3' to the oscillator 50.

The control unit 150 may determine whether it is necessary to change the output current IS3' of the current generator 100 based on the frequency of the clock signal CLK of the oscillator 50, and generate and output the current control signal ICS to the current generator 100 according to the determination result. The control unit 150 may be implemented as a processor such as a central processing unit (CPU) or an application processor (AP).

According to the current embodiments, the electronic system 10 generates current regardless of the change in a supply voltage, thereby performing reliable operations. The first current generation circuit 110, the second current generation circuit 120, and the current subtracting circuit 130 respectively output the first current IS1, the second current IS2, and the third current IS3 in the embodiments illustrated in FIG. 1. However, instead of the circuits 110, 120, and 130 directly outputting the first through third currents IS1, IS2, and IS3, each of the circuits 110, 120, and 130 may transmit a voltage level corresponding to one of the first through third currents IS1, IS2, and IS3 (as shown in a gate of a ninth transistor M9 connected to a second node N2 and a gate of a tenth transistor M10 connected to a third node N3 in FIG. 2).

Figure 2:
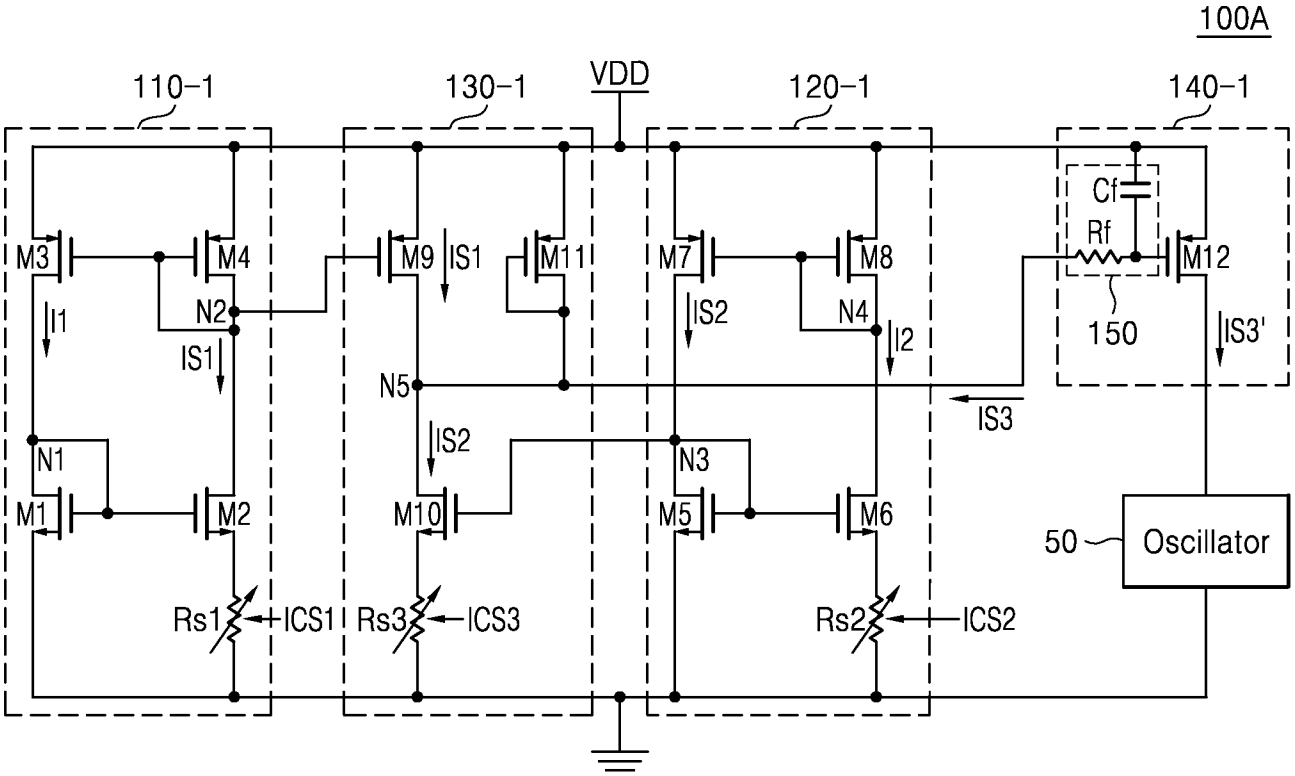
FIG. 2 is a diagram of an example of a current generator illustrated in FIG. 1.

FIG. 2 is a diagram of an example 100A of the current generator 100 illustrated in FIG. 1. Referring to FIGS. 1 and 2, the current generator 100A may include a first current generation circuit 110-1, a second current generation circuit 120-1, a current subtracting circuit 130-1, and a current output circuit 140-1.

The first current generation circuit 110-1 may include first through fourth transistors M1, M2, M3, and M4 and a first variable resistor Rs1. The first transistor M1 may be connected between a ground and a first node N1, and the second transistor M2 may be connected between the first variable resistor Rs1 and the second node N2. The first and second transistors M1 and M2 may have a common gate that may be connected to the first node N1. The first and second transistors M1 and M2 may be implemented by N-channel metal-oxide semiconductor (NMOS) transistors.

The third transistor M3 may be connected between a supply voltage VDD and the first node N1, and the fourth transistor M4 may be connected between the supply voltage VDD and the second node N2. The third and fourth transistors M3 and M4 may have a common gate that may be connected to the second node N2. The third and fourth transistors M3 and M4 may be implemented by P-channel metal-oxide semiconductor (PMOS) transistors.

The first through fourth transistors M1 through M4 may mirror a first reference current I1 flowing in the first node N1 and the first current IS1 flowing in the second node N2. A scaling ratio "c" of the first current IS1 to the first reference current I1 (i.e., c=IS1/I1) depends on a ratio of a channel width W of the first through fourth transistors M1 through M4 to a channel length L thereof (hereinafter, referred to as a "W/L ratio"). The W/L ratios of the respective first through fourth transistors M1 through M4 may be the same as one another or different from one another.

Consequently, the first current generation circuit 110-1 may receive the supply voltage VDD and generate the first reference current I1 from the supply voltage VDD and may generate the first current IS1 by scaling (up or down) the first reference current I1 by the scaling ratio "c". The transconductances of the respective first through fourth transistors M1 through M4 may be denoted by gm1, gm2, gm3, and gm4, respectively, and the output impedances thereof are denoted by ro1, ro2, ro3, and ro4.

A range of change in the first reference current I1 with respect to the supply voltage VDD, i.e., PSRR(a) of the first current generation circuit 110-1 may be expressed by Equation 1:

$$a = \frac{dI1}{dVDD} = \frac{1}{ro3}\left(\frac{gm1ro3/2}{gm1Rs1 - gm1ro3/2 + 1}\right). \quad (1)$$

It can be seen that the PSRR(a) of the first current generation circuit 110-1 depends on the transconductance gm1 of the first transistor M1, the transconductance gm3 and output impedance ro3 of the third transistor M3, and a resistance of the first variable resistor Rs1. The PSRR(a) of the first current generation circuit 110-1 can be changed to a wanted value by adjusting the variables.

The second current generation circuit 120-1 may include fifth through eighth transistors M5, M6, M7, and M8 and a second variable resistor Rs2. The connection among the fifth through eighth transistors M5 through M8 and the second variable resistor Rs2 and a type of the transistors M5 through M8 may be substantially the same as the connection among the first through fourth transistors M1 through M4 and the first variable resistor Rs1 and a type of the transistors M1 through M4.

The W/L ratio of the fifth through eighth transistors M5 through M8 may be the same as that of the first through fourth transistors M1 through M4, but it may be different from the W/L ratio of the first through fourth transistors M1 through M4. Therefore, a scaling ratio "d" (=IS2/I2) of the second current IS2 to a second reference current I2 may be the same as or different from the scaling ratio "c", i.e., IS1/I1.

Consequently, the second current generation circuit 120-1 may receive the supply voltage VDD and generate the second reference current I2 from the supply voltage VDD and may generate the second current IS2 by scaling the second reference current I2 by the scaling ratio "d", i.e., IS2/I2.

A rate of change in the second reference current I2 with respect to the supply voltage VDD, i.e., PSRR(b) of the second current generation circuit 120-1 may be expressed by Equation 2:

$$b = \frac{dI2}{dVDD} = \frac{1}{ro7}\left(\frac{gm5ro7/2}{gm5Rs2 - gm5ro7/2 + 1}\right). \quad (2)$$

It can be seen that the PSRR(b) of the second current generation circuit 120-1 depends on the transconductance gm5 of the fifth transistor M5, the transconductance gm7 and output impedance ro7 of the seventh transistor M7, and a resistance of the second variable resistor Rs2. The PSRR (b) of the second current generation circuit 120-1 can be changed to a wanted value by adjusting the variables.

The current subtracting circuit 130-1 may include ninth through eleventh transistors M9, M10, and M11. The ninth transistor M9 may be connected between the supply voltage VDD and a fifth node N5, and the tenth transistor M10 may be connected between the fifth node N5 and a third variable resistor Rs3. The eleventh transistor M11 may be connected between the supply voltage VDD and the fifth node N5. Gates of the respective ninth through eleventh transistors M9 through M11 may be connected to the second node N2, the third node N3, and the fifth node N5, respectively.

As the gate of the ninth transistor M9 is connected to the second node N2, a current flowing between a drain and a source of the ninth transistor M9 may be the same as the first current IS1 flowing the second node N2. As the gate of the tenth transistor M10 is connected to the third node N3, a current flowing between a drain and a source of the tenth transistor M10 may be the same as the second current IS2 flowing the third node N3.

The resistance of the third variable resistor Rs3 may be changed according to a third current control signal ICS3 received from the control unit 150. Therefore, the current between the source and the drain of the tenth transistor M10 may also be changed. Accordingly, a current flowing between a drain and a source of the eleventh transistor M11 may be the third current IS3 resulting from subtracting the first current IS1 from the second current IS2 according to the Kirchhoff's law. The relationship among the first reference current I1, the second reference current I2, and the first through third currents IS1 through IS3 is defined as Equation 3:

$$IS3=IS2-IS1=dI2s-cI1, \quad (3)$$

where "c" is the scaling ratio of the first current IS1 to the first reference current I1 and "d" is the scaling ratio of the second current IS2 to the second reference current I2.

A rate of change in the third current IS3 with respect to the supply voltage VDD may be obtained by partially differentiating both sides of Equation 3 with respect to the supply voltage VDD as shown in Equation 4:

$$\frac{dIS3}{dVDD}=d\frac{dI2}{dVDD}-c\frac{dI1}{dVDD}=bd-ac, \quad (4)$$

where "a" is PSRR(a) of the first current generation circuit 110-1 and "b" is PSRR(b) of the second current generation circuit 120-1.

The rate of change in the third current IS3 with respect to the supply voltage VDD may be set to 0 or a wanted value by adjusting the variables "a", "b", "c", and "d". When rate of change in the third current IS3 with respect to the supply voltage VDD is 0, this means that the third current IS3 is irrelevant to the change in the supply voltage VDD. In other words, the rate of change in the third current IS3 with respect to the supply voltage VDD can be set to a wanted value by adjusting the W/L ratio of each of the transistors M1 through M8 included in the first and second current generation circuits 110-1 and 120-1 and the resistance of the variable resistors Rs1 and Rs2. In particular, the resistance of the first variable resistor Rs1 may vary with a first current control signal ICS1 and the resistance of the second variable resistor Rs2 may vary with a second current control signal ICS2.

The current output circuit 140-1 may include an RC filter 150 and a twelfth transistor M12. The RC filter 150 may include a filtering resistor Rf and a filtering capacitor Cf. The filtering resistor Rf may be connected to the fifth node N5 and a gate of the twelfth transistor M12. The filtering capacitor Cf may be connected to the supply voltage VDD and the gate of the twelfth transistor M12.

The RC filter 150 is a high pass filter and blocks low-frequency noise (e.g., thermal noise and flicker noise). In particular, since the flicker noise is inversely proportional to frequency and thus exists mainly in a low-frequency range, it can be effectively removed by the RC filter 150.

The twelfth transistor M12 may be connected between the supply voltage VDD and the oscillator 50, and generate and output the third current IS3' with low-frequency noise removed to the oscillator 50. Since the twelfth transistor M12 is connected to the supply voltage VDD, current noise may be included in the third current IS3' after the low-frequency noise is removed. Therefore, the variables "a" through "d" may be adjusted to prevent other current noise from being included in the third current IS3' after the low-frequency noise is removed.

In other embodiments, additional transistors (not shown) whose source and drain are respectively connected to the source and drain of the twelfth transistor M12 may be provided in order to increase the output impedance of the twelfth transistor M12. In this case, when the output impedance of the twelfth transistor M12 is high enough, current noise in the third current IS3' with low-frequency noise removed may become so low as to be negligible.

Figure 3:
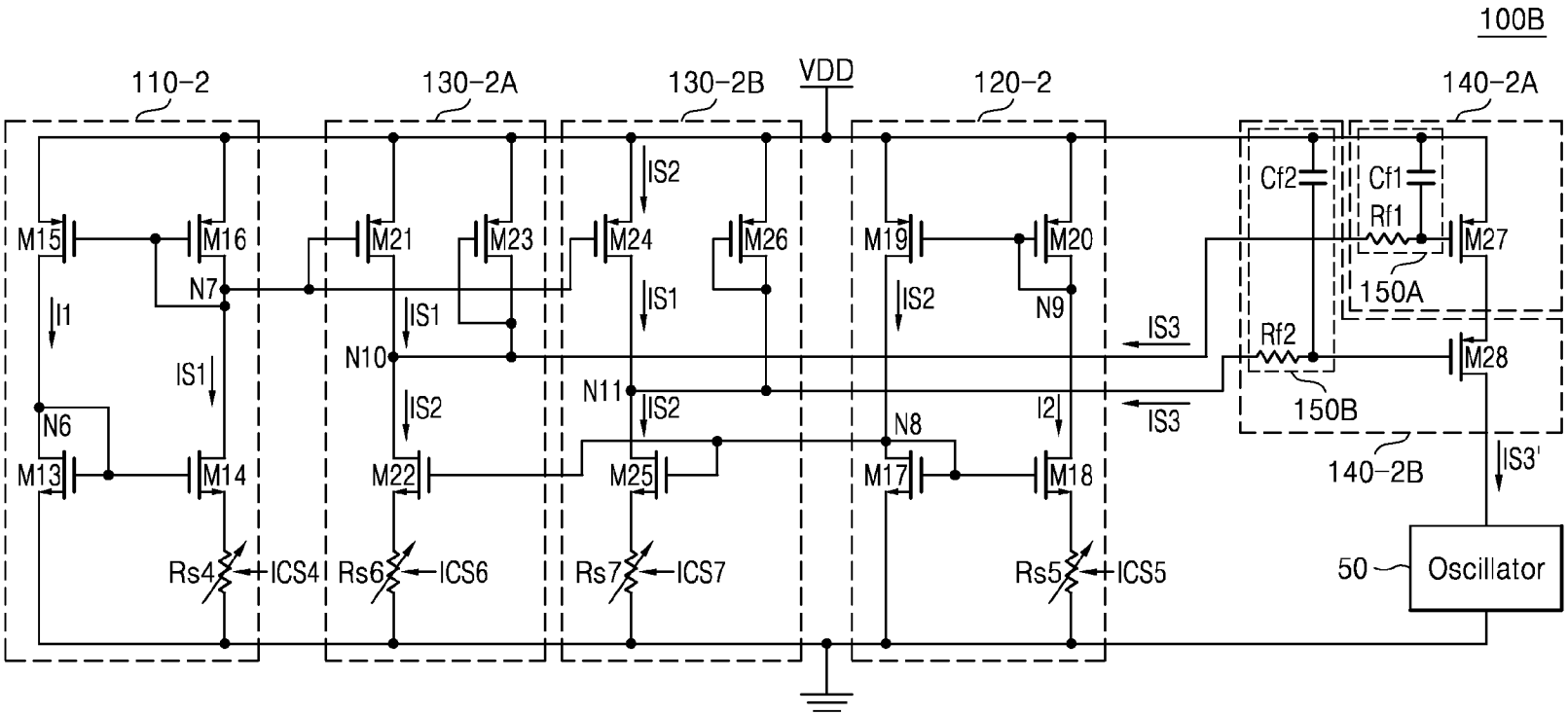
FIG. 3 is a diagram of another example of the current generator illustrated in FIG. 1.

FIG. 3 is a diagram of another example 100B of the current generator 100 illustrated in FIG. 1. Referring to FIGS. 1 through 3, the current generator 100B may include a first current generation circuit 110-2, a second current generation circuit 120-2, a first current subtracting circuit 130-2A, a second current subtracting circuit 130-2B, a first current output circuit 140-2A, and a second current output circuit 140-2B.

The structure and operation of the first and second current generation circuits 110-2 and 120-2 are substantially the same as those of the first and second current generation circuits 110-1 and 120-1 illustrated in FIG. 2. The structure and operation of each of the first and second current subtracting circuits 130-2A and 13-2B are substantially the same as those of the current subtracting circuit 130-1 illustrated in FIG. 2. The structure and operation of each of a first RC filter 150A included in the first current output circuit 140-2A and a second RC filter 150B included in the second current output circuit 140-2B are substantially the same as those of the RC filter 150 included in the current output circuit 140-1 illustrated in FIG. 2.

A twenty-seventh transistor M27 in the first current output circuit 140-2A may be connected with the supply voltage VDD and a twenty-eighth transistor M28 in the second current output circuit 140-2B. The twenty-eighth transistor M28 may be connected with the twenty-seventh transistor M27 and the oscillator 50.

The twenty-seventh transistor M27 and the twenty-eighth transistor M28 form a cascode circuit, so that the cascode circuit including the twenty-seventh transistor M27 and the twenty-eighth transistor M28 has very high output impedance. When the twenty-seventh transistor M27 is connected with the supply voltage VDD, current noise that may occur as described above with reference to FIG. 2 may become so low as to be negligible as the output impedance of the cascode circuit becomes very high.

Figure 4:
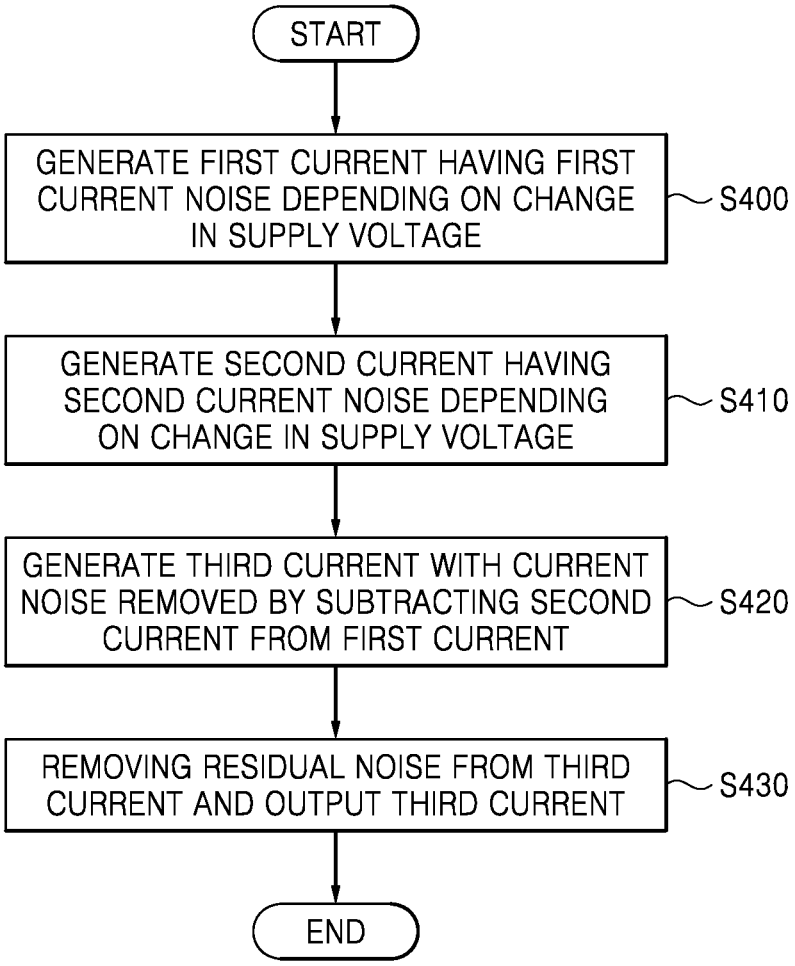
FIG. 4 is a flowchart of a method of operating the current generator illustrated in FIG. 1 according to some embodiments.
Figure 5:
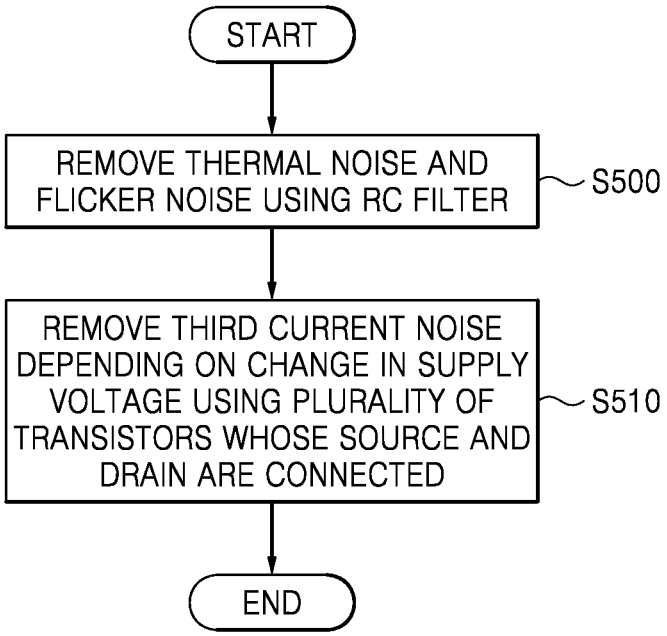
FIG. 5 is a flowchart of an operation of removing residual noise in the method illustrated in FIG. 4.

FIG. 4 is a flowchart of a method of operating the current generator 100 illustrated in FIG. 1 according to some embodiments. FIG. 5 is a flowchart of an operation of removing residual noise in the method illustrated in FIG. 4.

Referring to FIGS. 1 through 5, the first current generation circuit 110 may generate the first current IS1 having first current noise depending on the change in the supply voltage VDD in operation S400. The first current IS1 is a result of scaling the first reference current I1 at a first ratio, i.e., the scaling ratio "c" of the first current IS1 to the first reference current I1.

The second current generation circuit 120 may generate the second current IS2 having second current noise depending on the change in the supply voltage VDD in operation S410. The second current IS2 is a result of scaling the second reference current I2 at a second ratio, i.e., the scaling ratio "d" of the second current IS2 to the second reference current I2.

The current subtracting circuit 130 may generate the third current IS3' with the first current noise and the second current noise removed by subtracting the second current IS2 from the first current IS1 in operation S420.

A rate of change in the third current IS3 with respect to the supply voltage VDD depends on only the first ratio, the second ratio, a third ratio, i.e., PSRR(a) of the first current generation circuit 110, and a fourth ratio, i.e., PSRR(b) of the second current generation circuit 120. Accordingly, the rate of change in the third current IS3 with respect to the supply voltage VDD may be set to 0 or a wanted value by adjusting the first through fourth ratios. For this operation, operation S400 may include changing the third ratio according to the current control signal ICS of the control unit 150. In addition, operation S410 may include changing the fourth ratio according to the current control signal ICS of the control unit 150.

The current output circuit 140 may remove residual noise from the third current IS3 and output the third current IS3' with the residual noise removed in operation S430. Operation S430 may include removing thermal noise and flicker noise using the RC filter 150 included in the current output circuit 140 in operation S500 (see FIG. 5). Operation S430 may also include removing third current noise depending on the change in the supply voltage VDD using a transistor included in the current output circuit 140 in operation S510 (see FIG. 5). The transistor may be implemented using a plurality of transistors connected in a cascode structure or a plurality of transistors whose source and drain are connected.

Figure 6:
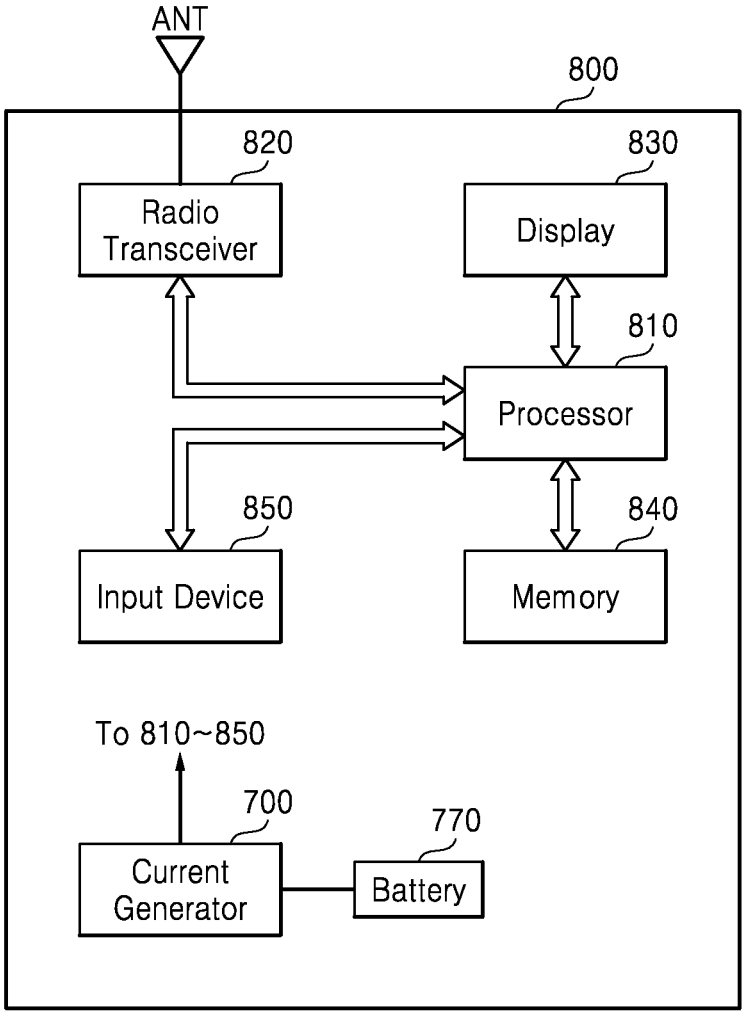
FIG. 6 is a block diagram of an electronic device including the current generator illustrated in FIG. 1 according to some embodiments.

FIG. 6 is a block diagram of an electronic device 800 including the current generator 100 illustrated in FIG. 1 according to some embodiments. Referring to FIGS. 1 through 6, the electronic device 800 such as a cellular phone, a smart phone, or a table PC includes a current generator 700 and a battery 770.

The current generator 700 is supplied with power from the battery 770 and supplies current to a processor 810, a radio transceiver 820, a display 830, a memory 840, or an input device 850. The processor 810, the radio transceiver 820, the display 830, the memory 840, or the input device 850 may include the oscillator 50 illustrated in FIG. 1. The current generator 700 may be implemented by the current generator 100 illustrated in FIG. 1.

The radio transceiver 820 transmits or receives radio signals through an antenna ANT. The radio transceiver 820 may convert radio signals received through the antenna ANT into signals that can be processed by the processor 810. The processor 810 may process the signals output from the radio transceiver 820 and store the processed signals in the memory 840 or display the processed signal through the display 830. The radio transceiver 820 may also convert signals output from the processor 810 into radio signals and output the radio signals to an external device through the antenna ANT.

The input device 850 enables control signals for controlling the operation of the processor 810 or data to be processed by the processor 810 to be input to the electronic device 800. The input device 850 may be implemented by a pointing device such as a touch pad or a computer mouse, a keypad, or a keyboard.

The processor 810 may control the operation of the display 830 to display data output from the memory 840, radio signals output from the radio transceiver 820, or data output from the input device 850.

Figure 7:
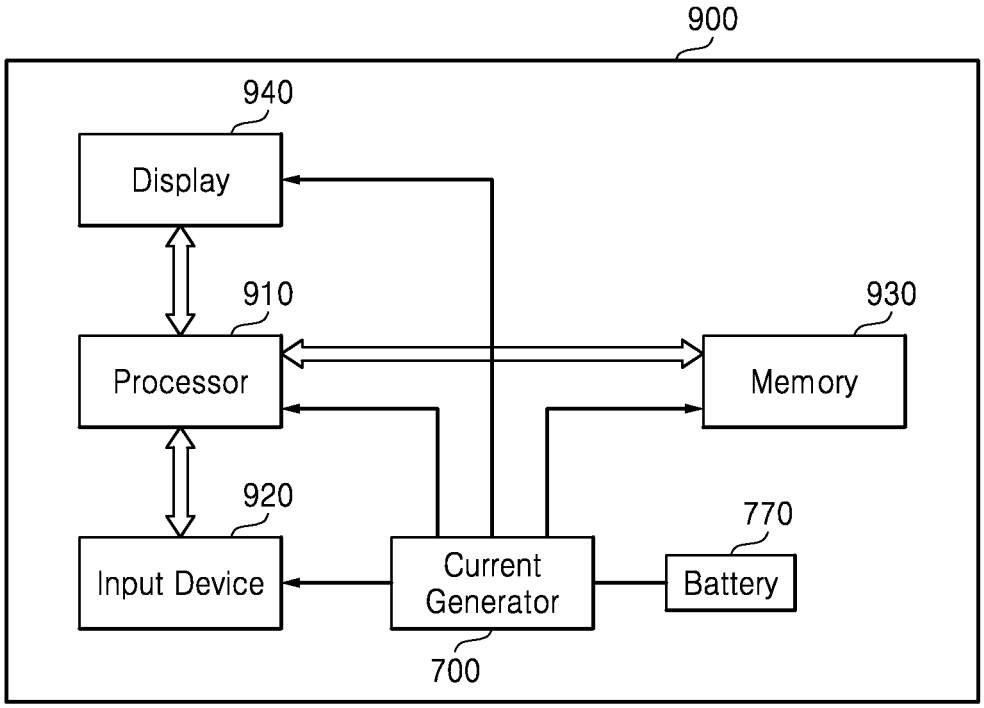
FIG. 7 is a block diagram of an electronic device including the current generator illustrated in FIG. 1 according to other embodiments.

FIG. 7 is a block diagram of an electronic device 900 including the current generator 100 illustrated in FIG. 1 according to other embodiments. Referring to FIGS. 1 through 7, the electronic device 900 may be implemented as a PC, a tablet computer, a net-book, an e-reader, a personal digital assistant (PDA), a portable multimedia player (PMP), an MP3 player, or an MP4 player. The electronic device 900 includes the current generator 700 and the battery 770.

The current generator 700 is supplied with power from the battery 770 and supplies current to a processor 910, an input device 920, a memory 930, or a display 940. The processor 910, the input device 920, the memory 930, or the display 940 may include the oscillator 50 illustrated in FIG. 1. The current generator 700 may be implemented by the current generator 100 illustrated in FIG. 1.

The processor 910 controls the overall operation of the electronic device 900. The processor 910 may display data stored in the memory 930 through the display 940 according to an input signal generated by the input device 920. The input device 920 may be implemented by a pointing device such as a touch pad or a computer mouse, a keypad, or a keyboard.

Figure 8:
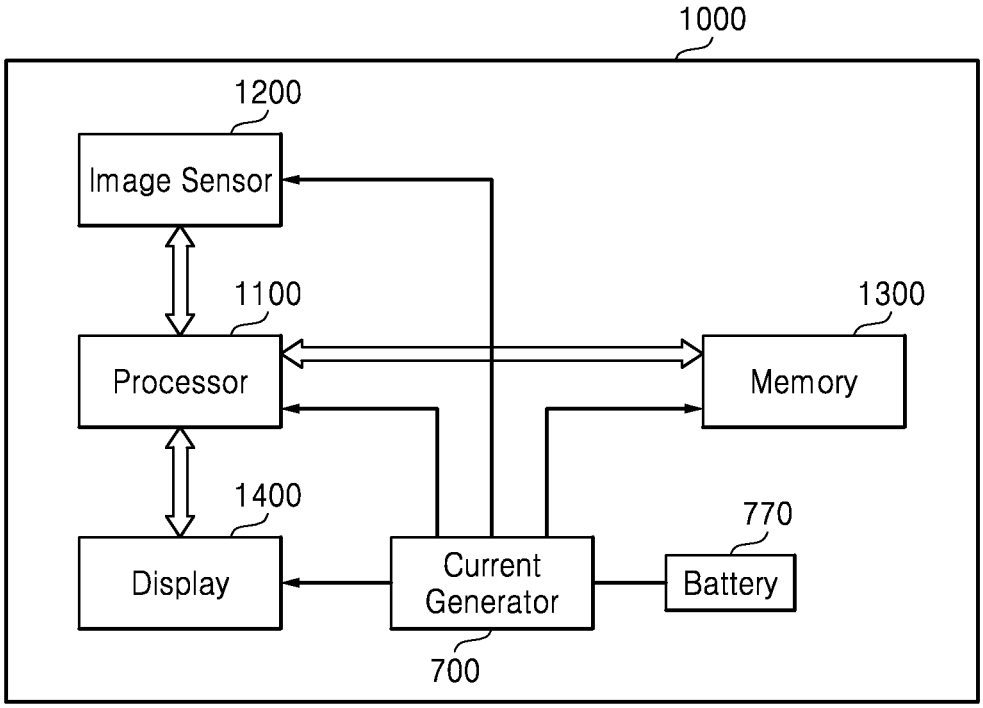
FIG. 8 is a block diagram of an electronic device including the current generator illustrated in FIG. 1 according to further embodiments.

FIG. 8 is a block diagram of an electronic device 1000 including the current generator 100 illustrated in FIG. 1 according to further embodiments. Referring to FIG. 1 through 8, the electronic device 1000 may be implemented as a digital camera. The electronic device 1000 includes the current generator 700 and the battery 770.

The current generator 700 is supplied with power from the battery 770 and supplies current to a processor 1100, an image sensor 1200, a memory 1300, or a display 1400. The processor 1100, the image sensor 1200, the memory 1300, or the display 1400 may include the oscillator 50 illustrated in FIG. 1. The current generator 700 may be implemented by the current generator 100 illustrated in FIG. 1.

The image sensor 1200 converts an optical signal into a digital signal. The digital signal is stored in the memory 1300 under the control of the processor 1100 or displayed through the display 1400. The digital signal stored in the memory device 1300 is displayed through the display 1400 under the control of the processor 1100.

The exemplary embodiments can also be embodied as computer-readable codes on a computer-readable medium. The computer-readable recording medium is any data storage device that can store data as a program which can be thereafter read by a computer system. Examples of the computer-readable recording medium include read-only memory (ROM), random-access memory (RAM), CD-ROMs, magnetic tapes, floppy disks, and optical data storage devices.

The computer-readable recording medium can also be distributed over network coupled computer systems so that the computer-readable code is stored and executed in a distributed fashion. Also, functional programs, codes, and code segments to accomplish the present general inventive concept can be easily construed by programmers.

As described above, according to some embodiments an electronic system generates current regardless of the change in a supply voltage, thereby operating reliably.

While the exemplary embodiments have been particularly shown and described with reference to exemplary embodiments thereof, it will be understood by those of ordinary skill in the art that various changes in forms and details may be made therein without departing from the spirit and scope as defined by the following claims.

What is claimed is:

1. A current generator comprising:

a first current generation circuit configured to generate a first current having a first current noise which depends on a change in a supply voltage;

a second current generation circuit configured to generate a second current having a second current noise which depends on the change in the supply voltage; and a current subtracting circuit configured to generate a third current with the first current noise and the second current noise removed by subtracting the second current from the first current, wherein the first current is a result of scaling a first reference current generated from the supply voltage at a first ratio, and the second current is a result of scaling a second reference current generated from the supply voltage at a second ratio, and the third current has a rate of change with respect to the supply voltage, which is determined according to the first ratio, the second ratio, a third ratio, and a fourth ratio, wherein the third ratio is a rate of change in the first reference current with respect to the supply voltage, and wherein the fourth ratio is a rate of change in the second reference current with respect to the supply voltage.

2. The current generator of claim 1, wherein the first current generation circuit comprises a first variable resistor configured to change the third ratio, and the second current generation circuit comprises a second variable resistor configured to change the fourth ratio.

3. The current generator of claim 1, further comprising a current output circuit configured to remove residual noise from the third current, and output the third current with the residual noise removed.

4. The current generator of claim 3, wherein the current output circuit comprises an RC filter.

5. The current generator of claim 1, wherein the current output circuit comprises a first transistor and a second transistor, a source of the second transistor being connected to a drain of the first transistor.

6. An electronic system comprising:

the current generator of claim 1;

an oscillator configured to receive the third current and generate a clock signal; and a control unit configured to generate a current control signal which controls the current generator according to a frequency of the clock signal.

7. A method of operating a current generator, the method comprising:

generating a first current having a first current noise which depends on a change in a supply voltage;

generating a second current having a second current noise which depends on the change in the supply voltage; and generating a third current with the first current noise and the second current noise removed by subtracting the second current from the first current, wherein the first current is a result of scaling a first reference current generated from the supply voltage at a first ratio, and the second current is a result of scaling a second reference current generated from the supply voltage at a second ratio, and the third current has a rate of change with respect to the supply voltage, which is determined according to the first ratio, the second ratio, a third ratio, and a fourth ratio, wherein the third ratio is a rate of change in the first reference current with respect to the supply voltage, and wherein the fourth ratio is a rate of change in the second reference current with respect to the supply voltage.

8. The method of claim 7, wherein the generating the first current comprises changing the third ratio, and the generating the second current comprises changing the fourth ratio.

9. The method of claim 7, further comprising removing residual noise from the third current, and outputting the third current with the residual noise removed.

10. The method of claim 9, wherein the removing the residual noise comprises removing thermal noise and flicker noise using an RC filter.

11. The method of claim 7, wherein the removing the residual noise comprises removing third current noise which depends on the change in the supply voltage using a first transistor and a second transistor, a source of the second transistor being connected to a drain of the first transistor.

* * * * *